US011471747B2

(12) United States Patent
Vaillancourt

(10) Patent No.: US 11,471,747 B2
(45) Date of Patent: Oct. 18, 2022

(54) BLOCKER FOR A GOALIE

(71) Applicant: Bauer Hockey Ltd., Blainville (CA)

(72) Inventor: Charles Vaillancourt, Blainville (CA)

(73) Assignee: BAUER HOCKEY LLC, Exeter, NH (US)

( * ) Notice: Subject to any disclaimer, the term of this patent is extended or adjusted under 35 U.S.C. 154(b) by 197 days.

(21) Appl. No.: 17/066,911

(22) Filed: Oct. 9, 2020

(65) Prior Publication Data

US 2021/0106901 A1 Apr. 15, 2021

Related U.S. Application Data

(60) Provisional application No. 62/913,977, filed on Oct. 11, 2019.

(51) Int. Cl.

| | |
|---|---|
| ***A63B 71/14*** | (2006.01) |
| ***A41D 19/015*** | (2006.01) |
| ***A41D 13/015*** | (2006.01) |
| *A63B 102/24* | (2015.01) |

(52) U.S. Cl.

CPC ..... *A63B 71/143* (2013.01); *A41D 13/015* (2013.01); *A41D 19/01523* (2013.01); *A41D 2600/10* (2013.01); *A63B 2102/24* (2015.10); *A63B 2209/10* (2013.01); *A63B 2225/09* (2013.01)

(58) Field of Classification Search

CPC ..... A63B 71/143; A63B 2225/09; A41D 13/015; Y10S 2/91

See application file for complete search history.

(56) References Cited

U.S. PATENT DOCUMENTS

| | | | | |
|---|---|---|---|---|
| 3,605,117 | A * | 9/1971 | Latina | A63B 71/143 2/16 |
| 3,626,515 | A * | 12/1971 | Murray | A63B 71/143 2/16 |
| 5,511,243 | A * | 4/1996 | Hall | A63B 71/143 2/161.1 |
| 2009/0106875 | A1* | 4/2009 | Christopher | A63B 71/1225 2/161.1 |
| 2016/0303463 | A1* | 10/2016 | Vaughn | A63B 71/143 |

* cited by examiner

*Primary Examiner* — Tajash D Patel

(57) ABSTRACT

A blocker for a hand of a goalie that is designed to be more comfortable and adjustable, including to enhance flexion and extension of fingers of the goalie's hand. The blocker may comprise: a glove configured to receive the goalie's hand and comprising finger portions configured to receive fingers of the goalie's hand; a blocking member disposed over the glove and configured to block a puck or ball; a finger-protecting member disposed between and movable relative to the blocking member and respective ones of the finger portions and configured to protect respective ones of the goalie's fingers that are received in the respective ones of the finger portions; and a connector connecting the finger-protecting member to a given one of the finger portions.

29 Claims, 11 Drawing Sheets

BLOCKER FOR A GOALIE

CROSS-REFERENCE TO RELATED APPLICATION

This application claims the benefit of U.S. Provisional Patent Application Ser. No. 62/913,977, filed on Oct. 11, 2020. The contents of the aforementioned application are incorporated by reference herein.

FIELD

This disclosure relates generally to equipment for hockey goalkeepers (i.e., goalies) and, more particularly, to blockers for goalies.

BACKGROUND

Hockey goalkeepers, a.k.a. goalies, defend their team's net in a hockey game. To that end, a goalie wears various equipment, including skates to move on a playing surface (e.g., ice), leg pads to protect his/her legs when used to stop a puck or ball and/or when moving (e.g., dropping) them onto the playing surface, and a blocker and a catcher to stop the puck or ball with his/her arms and hands.

A goalie's blocker comprises a glove configured to receive the goalie's hand and a blocking member, sometimes referred to as a blocking "board" or "shield", disposed over the glove and configured to block the puck or ball. One or more finger protectors are typically disposed between the blocking member and finger portions of the glove and configured to protect the goalie's fingers.

While it may provide suitable protection, a goalie's blocker may create some discomfort or other issues for a goalie, such as when closing his/her hand (e.g., to grab his/her hockey stick).

For these and/or other reasons, there is a need to improve blockers for goalies.

SUMMARY

According to various aspects, this disclosure relates to a blocker for a hand of a goalie that is designed to be more comfortable and adjustable, including to enhance flexion and extension of fingers of the goalie's hand.

For example, according to one aspect, this disclosure relates to a blocker for a hand of a goalie. The blocker comprises a glove configured to receive the goalie's hand. The glove comprises finger portions configured to receive fingers of the goalie's hand. The glove also comprises a thumb portion configured to receive a thumb of the goalie's hand. The blocker also comprises a blocking member disposed over the glove and configured to block a puck or ball. The blocker further comprises a finger-protecting member disposed between and movable relative to the blocking member and respective ones of the finger portions and configured to protect respective ones of the goalie's fingers that are received in the respective ones of the finger portions. The blocker also comprises a connector connecting the finger-protecting member to a given one of the finger portions. The connector extends foldlessly between the finger-protecting member and the given one of the finger portions.

According to another aspect, this disclosure relates to a blocker for a hand of a goalie. The blocker comprises a glove configured to receive the goalie's hand. The glove comprises finger portions configured to receive fingers of the goalie's hand. The glove also comprises a thumb portion configured to receive a thumb of the goalie's hand. The blocker also comprises a blocking member disposed over the glove and configured to block a puck or ball. The blocker further comprises a finger-protecting member disposed between and movable relative to the blocking member and respective ones of the finger portions and configured to protect respective ones of the goalie's fingers that are received in the respective ones of the finger portions. The blocker also comprises a connector connecting the finger-protecting member to a given one of the finger portions. The connector is straight in a widthwise direction of the connector from a connection of the connector to the given one of the finger portions to a connection of the connector to the finger-protecting member, the connection of the connector to the finger-protecting member being located on an inner side of the finger-protecting member.

According to yet another aspect, this disclosure relates to a blocker for a hand of a goalie. The blocker comprises a glove configured to receive the goalie's hand. The glove comprises finger portions configured to receive fingers of the goalie's hand. The glove also comprises a thumb portion configured to receive a thumb of the goalie's hand. The blocker also comprises a blocking member disposed over the glove and configured to block a puck or ball. The blocker further comprises a finger-protecting member disposed between and movable relative to the blocking member and respective ones of the finger portions and configured to protect respective ones of the goalie's fingers that are received in the respective ones of the finger portions. The blocker also comprises a connector connecting the finger-protecting member to a given one of the finger portions. A width of the connector at a connection of the connector to the given one of the finger portions is transverse to a longitudinal direction of the given one of the finger portions, the connection of the connector to the given one of the finger portions is spaced from a palm side of the given one of the finger portions.

According to yet another aspect, this disclosure relates to a blocker for a hand of a goalie. The blocker comprises a glove configured to receive the goalie's hand. The glove comprises finger portions configured to receive fingers of the goalie's hand. The glove also comprises a thumb portion configured to receive a thumb of the goalie's hand. The blocker also comprises a blocking member disposed over the glove and configured to block a puck or ball. The blocker further comprises a finger-protecting member disposed between and movable relative to the blocking member and respective ones of the finger portions and configured to protect respective ones of the goalie's fingers that are received in the respective ones of the finger portions. The blocker also comprises a connector connecting the finger-protecting member to a given one of the finger portions. The connector is connected at a back side of the given one of the finger portions and spaced from lateral sides of the given one of the finger portions.

According to yet another aspect, this disclosure relates to a blocker for a hand of a goalie. The blocker comprises a glove configured to receive the goalie's hand. The glove comprises finger portions configured to receive fingers of the goalie's hand. The glove also comprises a thumb portion configured to receive a thumb of the goalie's hand. The blocker also comprises a blocking member disposed over the glove and configured to block a puck or ball. The blocker further comprises a finger-protecting member disposed between and movable relative to the blocking member and respective ones of the finger portions and configured to protect respective ones of the goalie's fingers that are received in the respective ones of the finger portions. The blocker also comprises a connector connecting the finger-protecting member to a given one of the finger portions. The connector is adjustable.

According to yet another aspect, this disclosure relates to a blocker for a hand of a goalie. The blocker comprises a glove configured to receive the goalie's hand. The glove comprises finger portions configured to receive fingers of the goalie's hand. The glove also comprises a thumb portion configured to receive a thumb of the goalie's hand. The blocker also comprises a blocking member disposed over the glove and configured to block a puck or ball. The blocker further comprises a finger-protecting member disposed between and movable relative to the blocking member and respective ones of the finger portions and configured to protect respective ones of the goalie's fingers that are received in the respective ones of the finger portions. The blocker also comprises a connector connecting the finger-protecting member to a given one of the finger portions. A force exerted by the connector between the given one of the finger portions and the finger-protecting member is adjustable.

According to yet another aspect, this disclosure relates to a blocker for a hand of a goalie. The blocker comprises a glove configured to receive the goalie's hand. The glove comprises finger portions configured to receive fingers of the goalie's hand. The glove also comprises a thumb portion configured to receive a thumb of the goalie's hand. The blocker also comprises a blocking member disposed over the glove and configured to block a puck or ball. The blocker further comprises a finger-protecting member disposed between and movable relative to the blocking member and respective ones of the finger portions and configured to protect respective ones of the goalie's fingers that are received in the respective ones of the finger portions. The blocker also comprises a connector connecting the finger-protecting member to a given one of the finger portions. The connector is detachably fastenable to an inside surface of the finger-protecting member.

These and other aspects of this disclosure will now become apparent to those of ordinary skill upon review of a description of embodiments that follows in conjunction with accompanying drawings.

BRIEF DESCRIPTION OF DRAWINGS

A detailed description of embodiments is provided below, by way of example only, with reference to accompanying drawings, in which.

It is to be expressly understood that the description and drawings are only for purposes of illustrating certain embodiments and are an aid for understanding. They are not intended to be and should not be limiting.

DETAILED DESCRIPTION OF EMBODIMENTS

Figure 1:
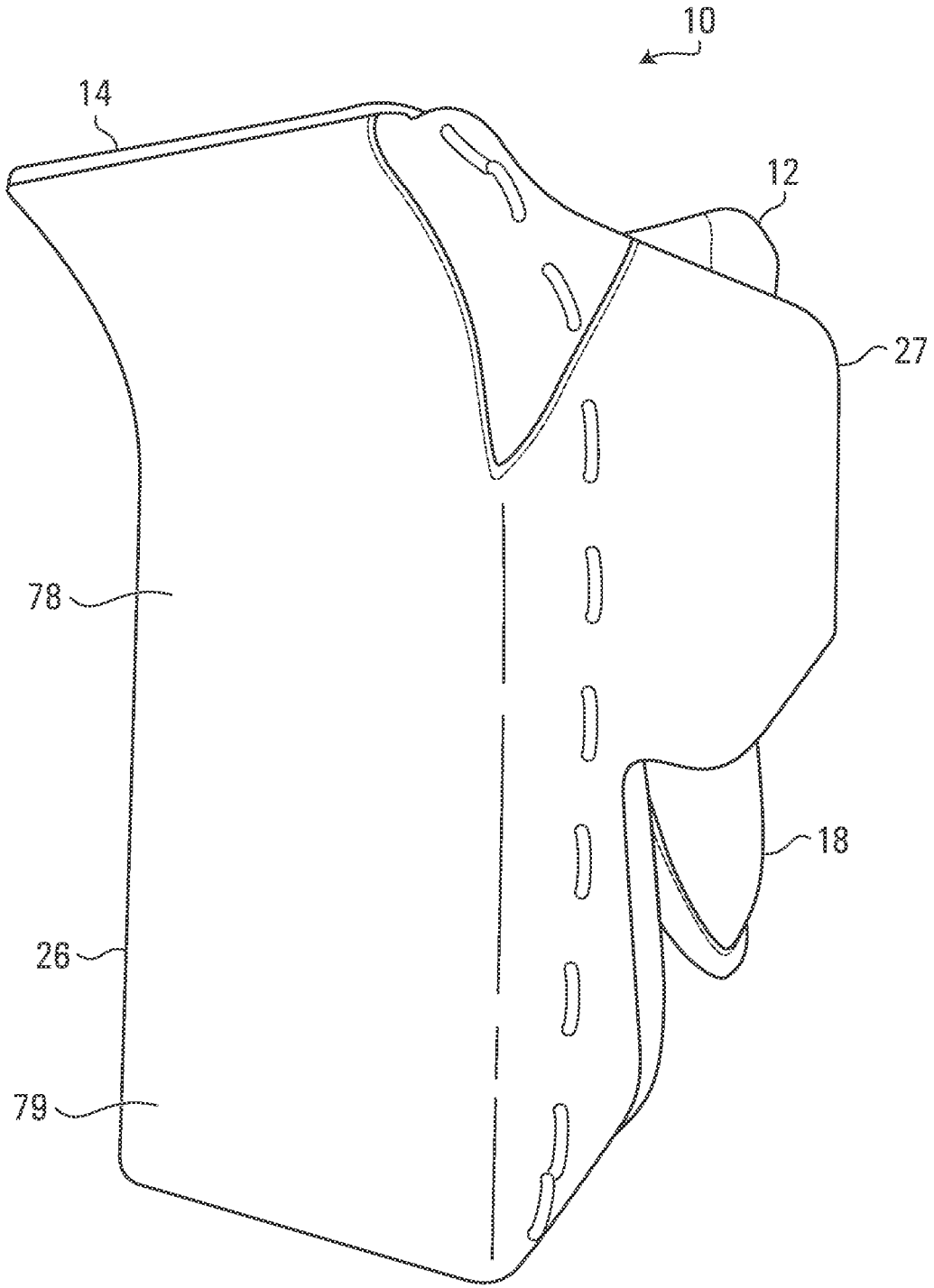
FIG. 1 shows an embodiment of a blocker for a hand of a goalie.
Figure 2:
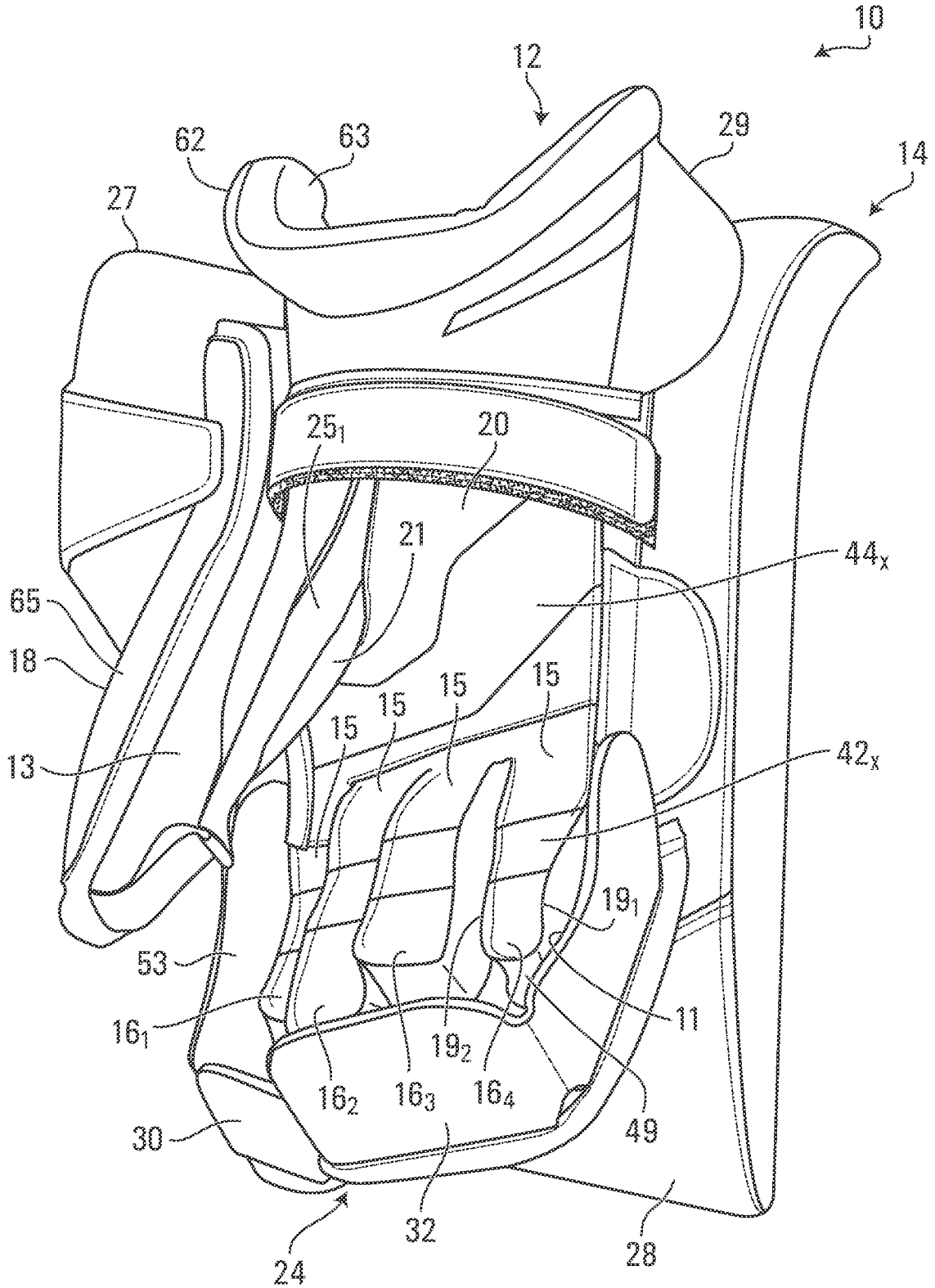
FIG. 2 is a palmar view of the blocker of FIG. 1.
Figure 3:
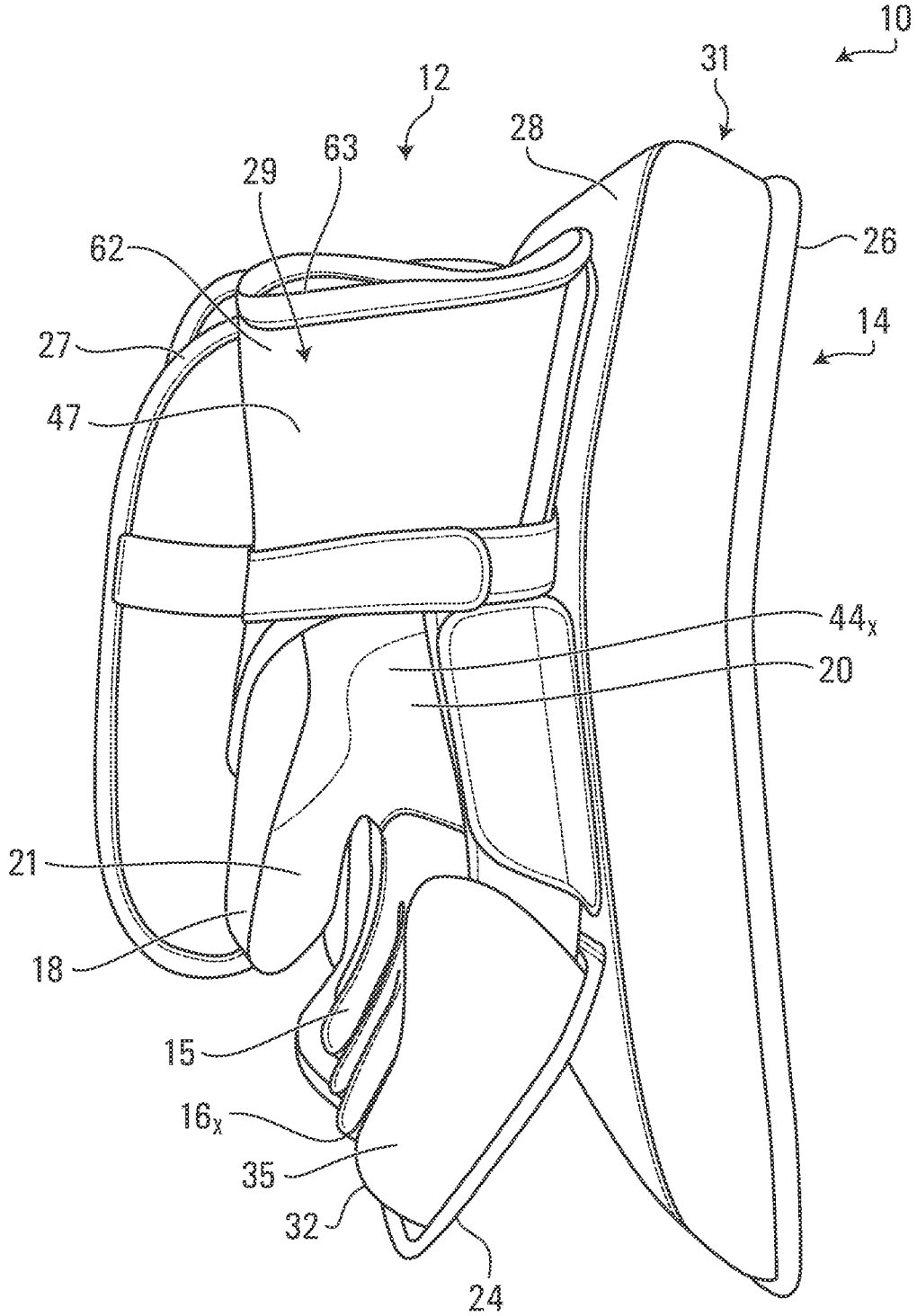
FIG. 3 is a side view of the blocker of FIG. 1.

FIGS. 1 to 3 show an embodiment of a blocker 10 for a hand of a goalie (i.e., goalkeeper) to block a projectile such as a puck or ball while playing hockey (e.g., when it is shot towards a hockey net tended by the goalie). In this embodiment, the goalie is playing ice hockey, the projectile is a puck, and the blocker 10 is configured to block the puck.

As further discussed below, in this embodiment, the blocker 10 is designed to be more comfortable and adjustable, including to enhance flexion and extension of fingers of the goalie's hand.

As best shown in FIGS. 1, 2 and 3, the blocker 10 comprises a glove 12 configured to receive the goalie's hand and a blocking member 14 disposed over the glove 12 and configured to block the puck. The glove 12 comprises finger portions $\mathbf{16}_1$-$\mathbf{16}_4$ configured to receive the goalie's fingers, a thumb portion 18 configured to receive a thumb of the goalie's hand, a palm portion 20 configured to overlie a palm of the goalie's hand, and a back portion 22 configured to overlie a back (i.e., dorsum) of the goalie's hand.

In this embodiment, the blocker 10 comprises a finger-protecting member 24 disposed between and movable relative to the blocking member 14 and respective ones of the finger portions $\mathbf{16}_1$-$\mathbf{16}_4$ of the glove 12 and configured to protect respective ones of the goalie's fingers that are received in the respective ones of the finger portions $\mathbf{16}_1$-$\mathbf{16}_4$ of the glove 12. The blocker 10 also comprises a side-protecting member 27 overlying and movable relative to the thumb portion 18 of the glove 12 and configured to protect a side of the goalie's hand, as well as a cuff 29 configured to overlie a wrist of the goalie.

The glove 12 may be affixed to the blocking member 14 in any suitable manner. In one embodiment, the glove 12 may be configured to be detachable from the blocking member 14. In another embodiment, the glove 12 may be made integral with the blocking member 14.

Figure 5A:
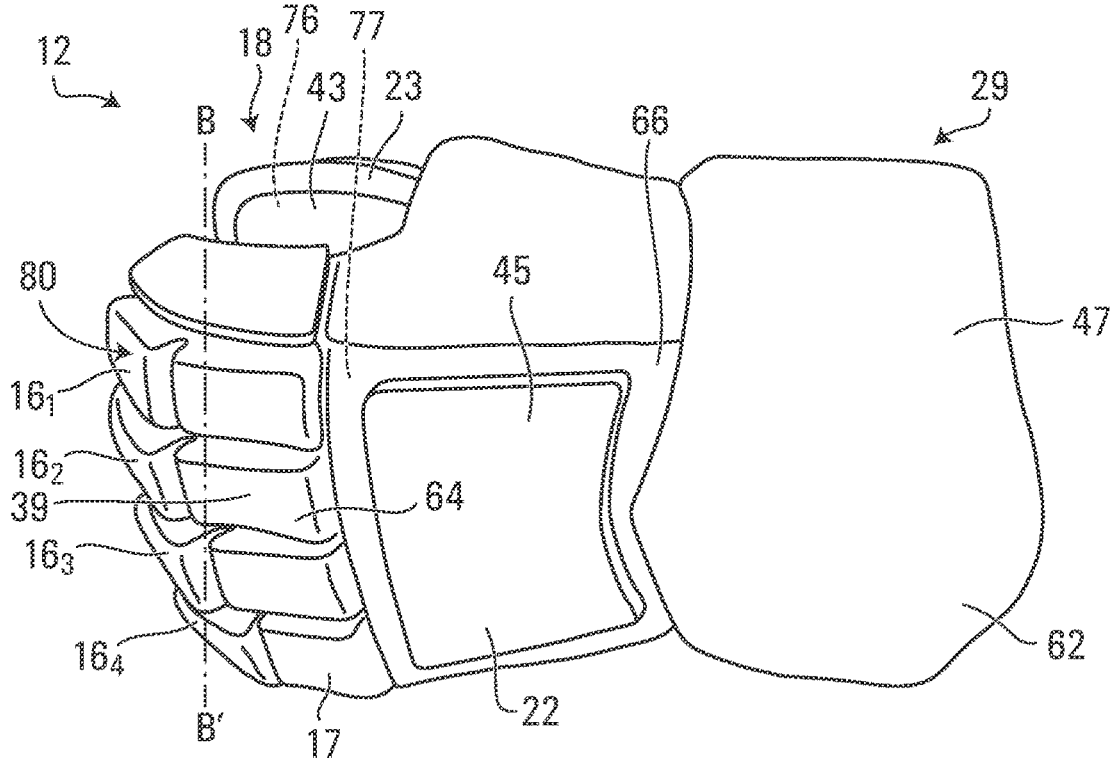
FIG. 5A is a dorsal view of a glove of the blocker.
Figure 5B:
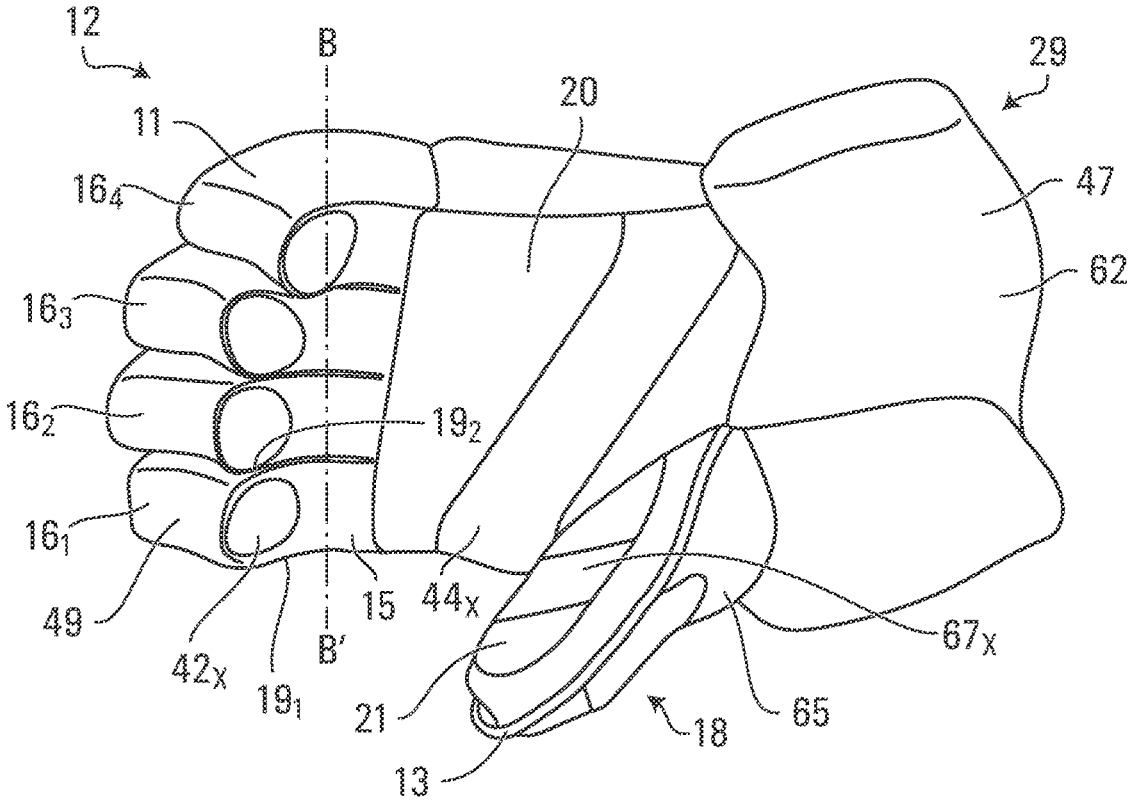
FIG. 5B is a palmar view of the glove of the blocker.

As best shown in FIGS. 5A and 5B, in this embodiment, each finger portion $\mathbf{16}_x$ of the finger portions $\mathbf{16}_1$-$\mathbf{16}_4$ comprises a palm side 15, a back side 17, and lateral sides $\mathbf{19}_1$, $\mathbf{19}_2$, which may be part of a gusset 11.

The back side 17 of the finger portion $\mathbf{16}_x$ may include any suitable material. For example, the back side 17 may include nylon, a tricot material, a woven fabric, a nonwoven fabric, synthetic microfibers, a synthetic woven knit, a polyurethane laminate, or any other suitable material. The back side 17 may be comprised of a single layer of material or, in another embodiment, may be comprised of a plurality of layers of material.

The back side 17 of the finger portion $\mathbf{16}_x$ may comprise protective padding 39 in order to protect the goalie's finger which is received in the finger portions 16*x* from impact. In one embodiment, the protective padding 39 may be disposed between an inner liner 75 and an outer cover 64 of the back side 17 of the finger portion $\mathbf{16}_x$.

For example, in some cases, the outer cover 64 may comprise an elastic non-foam polymeric material. For instance, in some cases, the outer cover 64 may comprise polyurethane (PU) or spandex. In another embodiment, the outer cover 64 may comprise any durable material, resistant to abrasion and tearing, such as polyethylene (PE), nylon, or leather.

The inner liner 75 of the back side 17 of the finger portion $\mathbf{16}_x$ may comprise a fabric material. For instance, in some examples of implementation, the fabric material of the inner liner 75 may comprise a woven fabric, a nonwoven fabric, synthetic microfibers, a synthetic woven knit, a polyurethane laminate, or any other suitable fabric.

The protective padding 39 may comprise any suitable impact-absorbing material. For example, the protective padding 39 may comprise foam. In some examples of implementation, the foam may be polyurethane sponge foam, Poron®, ethylene vinyl acetate (EVA) foam, low-density polyethylene (LDPE), expanded polypropylene (EPP) foam, expanded polyethylene (EPE) foam, vinyl nitrile (VN) foam, or any other suitable foam. In other examples, the protective padding 39 may comprise a gel. In one embodiment, the protective padding 39 may include only a single layer of padding material. In another embodiment, the protective padding 39 may comprise plural layers of padding material. The plural layers of padding materials may each comprise the same material or may comprise different materials. The protective padding 39 of the back side 17 of the finger portion $\mathbf{16}_x$ may be divided into a plurality of segments to facilitate movement of the finger received in the finger portion $\mathbf{16}_x$.

The palm side 15 of the finger portion $\mathbf{16}_x$ may include any suitable material (e.g. which may improve grip and handling of the goalie's hockey stick). For example, in some embodiments, the palm side 15 may comprise the same material(s) as the back side 17 of the finger portion $\mathbf{16}_x$, without protective padding. In another embodiment, the palm side 15 of the finger portion $\mathbf{16}_x$ may comprise a different material than the back side 17 of the finger portion $\mathbf{16}_x$. For instance, in some embodiments, the palm side 15 may comprise natural or synthetic suede, natural or synthetic leather, mesh or any other suitable material. The palm side 15 of the finger portion $\mathbf{16}_x$ may include only a single layer of material. In another embodiment, the palm side 15 of the finger portion $\mathbf{16}_x$ may comprise plural layers of material. In some embodiments, the palm side 15 of the finger portions $\mathbf{16}_x$ may comprise areas of reinforcement 42*x*. The areas of reinforcement 42*x* are configured to provide additional wear resistance to areas which may be vulnerable to increased wear. The areas of reinforcement 42*x* of the palm side 15 of the finger portion $\mathbf{16}_x$ may comprise any suitable material. More particularly, in some embodiments, the areas of reinforcement 42*x* may comprise the same material(s) as the palm side 15 of the finger portion $\mathbf{16}_x$. In another embodiment, the areas of reinforcement 42*x* may comprise a different material than the palm side 15 of the finger portion $\mathbf{16}_x$.

Similarly, in this embodiment, the thumb portion 18 comprises a palm side 21, a back side 23, and lateral sides $\mathbf{25}_1$, $\mathbf{25}_2$, which may be part of a gusset 13.

The back side 23 of the thumb portion 18 may include any suitable material. For example, the back side 23 may include nylon, a tricot material, a woven fabric, a nonwoven fabric, synthetic microfibers, a synthetic woven knit, a polyurethane laminate, or any other suitable material. The back side 23 may be comprised of a single layer of material or, in another embodiment, may be comprised of a plurality of layers of material.

The back side 23 of the thumb portion 18 may comprise protective padding 43 in order to protect the goalie's thumb which is received in the thumb portion 18 from impact. In one embodiment, the protective padding 43 may be disposed between an inner liner 76 and an outer cover 65 of the back side 23 of the thumb portion 18.

For example, in some cases, the outer cover 65 may comprise an elastic non-foam polymeric material. For instance, in some cases, the outer cover 65 may comprise polyurethane or spandex. In another embodiment, the outer cover 65 may comprise any durable material, resistant to abrasion and tearing, such as polyethylene (PE), nylon, or leather.

The inner liner 76 of the back side 23 of the thumb portion 18 may comprise a fabric material. For instance, in some examples of implementation, the fabric material of the inner liner 76 may comprise a woven fabric, a nonwoven fabric, synthetic microfibers, a synthetic woven knit, a polyurethane laminate, or any other suitable fabric.

The protective padding 43 may comprise any suitable impact-absorbing material. For example, the protective padding 43 may comprise foam. In some examples of implementation, the foam may be polyurethane sponge foam, Poron®, ethylene vinyl acetate (EVA) foam, low-density polyethylene (LDPE), expanded polypropylene (EPP) foam, expanded polyethylene (EPE) foam, vinyl nitrile (VN) foam, or any other suitable foam. In other examples, the protective padding 39 may comprise a gel. In one embodiment, the protective padding 43 may include only a single layer of padding material. In another embodiment, the protective padding 43 may comprise plural layers of padding material. The protective padding 43 of the back side 23 of the thumb portion 18 may be divided into a plurality of segments to facilitate movement of the thumb received in the thumb portion 18.

The palm side 21 of the thumb portion 18 may include any suitable material (e.g. which may improve grip and handling of the goalie's hockey stick). For example, in some embodiments, the palm side 21 may include the same material(s) as the back side 23 of thumb portion 18, without protective padding. In another embodiment, the palm side 21 of the thumb portion 18 may comprise a different material than the back side 23 of the thumb portion 18. For instance, in some embodiments, the palm side 21 of the thumb portion 18 may comprise natural or synthetic suede, natural or synthetic leather, mesh or any other suitable material. The palm side 21 of the thumb portion 18 may include only a single layer of material. In another embodiment, the palm side 21 of the thumb portion 18 may comprise plural layers of material. In some embodiments, the palm side 21 may comprise areas of reinforcement 67*x*. The areas of reinforcement 67*x* are configured to provide additional wear resistance to areas which may be vulnerable to increased wear. The areas of reinforcement 67*x* of the palm side 21 of the thumb portion 18 may be comprised of any suitable material. More particularly, the areas of reinforcement 67*x* may comprise the same material(s) as the palm side 21 of the thumb portion 18.

In another embodiment, the areas of reinforcement 67*x* may comprise a different material than the palm side 21 of the thumb portion 18.

The back portion 22 of the glove 12 may include any suitable material. For example, the back portion 22 may include nylon, a woven fabric, a nonwoven fabric, synthetic microfibers, a synthetic woven knit, a polyurethane laminate, or any other suitable material. The back portion 22 may be comprised of a single layer of material or, in another embodiment, may be comprised of a plurality of layers of material.

The back portion 22 of the glove 12 may comprise protective padding 45 in order to protect the dorsal portion of the goalie's hand which is received in the glove from impact. In one embodiment, the protective padding 45 may be disposed between an inner liner 77 and an outer cover 66 of the back portion 22.

For example, in some cases, the outer cover 66 may comprise an elastic non-foam polymeric material. For instance, in some cases, the outer cover 66 may comprise polyurethane (PU) or spandex. In another embodiment, the outer cover 66 may comprise any durable material, resistant to abrasion and tearing, such as polyethylene (PE), nylon, or leather.

The inner liner 77 of the back portion 22 of the glove 12 may comprise a fabric material. For instance, in some examples of implementation, the fabric material of the inner liner 77 may comprise a woven fabric, a nonwoven fabric, synthetic microfibers, a synthetic woven knit, a polyurethane laminate, or any other suitable fabric.

The protective padding 45 may comprise any suitable impact-absorbing material. For example, the protective padding 45 may comprise foam. In some examples of implementation, the foam may be polyurethane sponge foam, Poron®, ethylene vinyl acetate (EVA) foam, low-density polyethylene (LDPE), expanded polypropylene (EPP) foam, expanded polyethylene (EPE) foam, vinyl nitrile (VN) foam, or any other suitable foam. In other examples, the protective padding 45 may comprise a gel. In one embodiment, the protective padding 45 may include only a single layer of padding material. In another embodiment, the protective padding may comprise plural layers of padding material. The protective padding 45 of the back portion 22 may be divided into a plurality of segments 45*x* to facilitate movement of the hand received in the back portion.

The palm portion 20 of the glove 12 may include any suitable material (e.g. which may improve grip and handling of the goalie's hockey stick). For example, in some embodiments, the palm portion 20 may comprise the same material(s) as the back portion 22 of the glove 12, without protective padding. In another embodiment, the palm portion 20 of the glove 12 may comprise a different material than the back portion 22 of the glove 12. For instance, in some embodiments, the palm portion 20 may comprise natural or synthetic suede, natural or synthetic leather, mesh or any other suitable material. The palm portion 20 of the glove 12 may include only a single layer of material. In another embodiment, the palm portion 20 of the glove 12 may comprise plural layers of material. In some embodiments, the palm portion 20 may comprise areas of reinforcement 44*x*. The areas of reinforcement 44*x* of palm portion 20 of the glove 12 are configured to provide additional wear resistance to areas which may be vulnerable to increased wear. The areas of reinforcement 44*x* of the palm portion 20 of the glove 12 may comprise any suitable material. More particularly, in some embodiments, the areas of reinforcement 44*x* may comprise the same material(s) as the palm portion 20 of the glove 12. In another embodiment, the areas of reinforcement 44*x* may comprise a different material than the palm portion 20 of the glove 12.

The gussets 11 and 13 may include any suitable material, such as any suitably elastic material. For example, the gussets 11 and 13 may include Lycra®, latex or spandex. The palm side 15 and the back side 17 of each of the finger portions $\mathbf{16}_1$-$\mathbf{16}_4$ may be affixed to the gusset 11 in any suitable manner. For example, the palm side 15 and the back side 17 of each of the finger portions $\mathbf{16}_1$-$\mathbf{16}_4$ may be stitched, bonded, or glued to the gusset 11. Similarly, the palm side 21 and the back side 23 of the thumb portion 18 may also be affixed to the gusset 13 in the same ways. In another embodiment, the gusset 11 may be comprised of a plurality of materials. In another embodiment, the gusset 11 may be reinforced in certain areas which may be vulnerable to increased wear.

The palm portion 20, the back portion 22, the finger portions $\mathbf{16}_1$-$\mathbf{16}_4$, and the thumb portion 18 may be affixed in any suitable manner. For example, in some embodiments, the palm portion 20, the back portion 22, the finger portions $\mathbf{16}_1$-$\mathbf{16}_4$, and the thumb portion 18 may be stitched, glued, bonded. In another embodiment, part or all of the palm portion 20, the back portion 22, the finger portions $\mathbf{16}_1$-$\mathbf{16}_4$, and the thumb portion 18 may be made integrally as one piece.

The cuff 29 comprises an outer cover 62 and an inner cover 63 and protective padding 47 disposed between the outer cover 62 and the inner cover 63.

The outer cover 62 and the inner cover 63 may include any suitable material (e.g. any durable material, resistant to abrasion and tearing). For example, in some embodiments, the outer cover 62 and the inner cover 63 may include polyurethane (PU), polyethylene (PE), nylon, or leather. The outer cover 62 and the inner cover 63 may be affixed to each other in any suitable manner. For example, the outer cover 62 and the inner cover 63 may be stitched, bonded or glued together.

The protective padding 47 is provided in order to protect the goalie's wrist which is received in the cuff 29 from impact. The protective padding 47 may comprise any suitable impact-absorbing material. For example, the protective padding 47 may comprise foam. In some examples of implementation, the foam may be polyurethane sponge foam, Poron®, ethylene vinyl acetate (EVA) foam, low-density polyethylene (LDPE), expanded polypropylene (EPP) foam, expanded polyethylene (EPE) foam, vinyl nitrile (VN) foam, or any other suitable foam. In other examples, the protective padding 47 may comprise a gel. In one embodiment, the protective padding 47 may include only a single layer of padding material. In another embodiment, the protective padding 47 may comprise plural layers of padding material.

In another embodiment, the cuff 29 may comprise a plurality of cuff members 29*x* movable relative to one another.

The blocking member 14, which may sometimes also be referred to as a blocking "board", "guard" or "shield", is disposed over the glove 12 and configured to block the puck.

More particularly, in this embodiment, the blocking member 14 is larger than the glove 12 in a longitudinal direction and a widthwise direction of the blocker 10. In this embodiment, the blocking member 14 comprises a substantially planar projectile-engaging front surface 78 and an outwardly-angled (e.g., flared) lower front surface 79. The blocking member 14 may have any other suitable shape in other embodiments.

Figure 4:
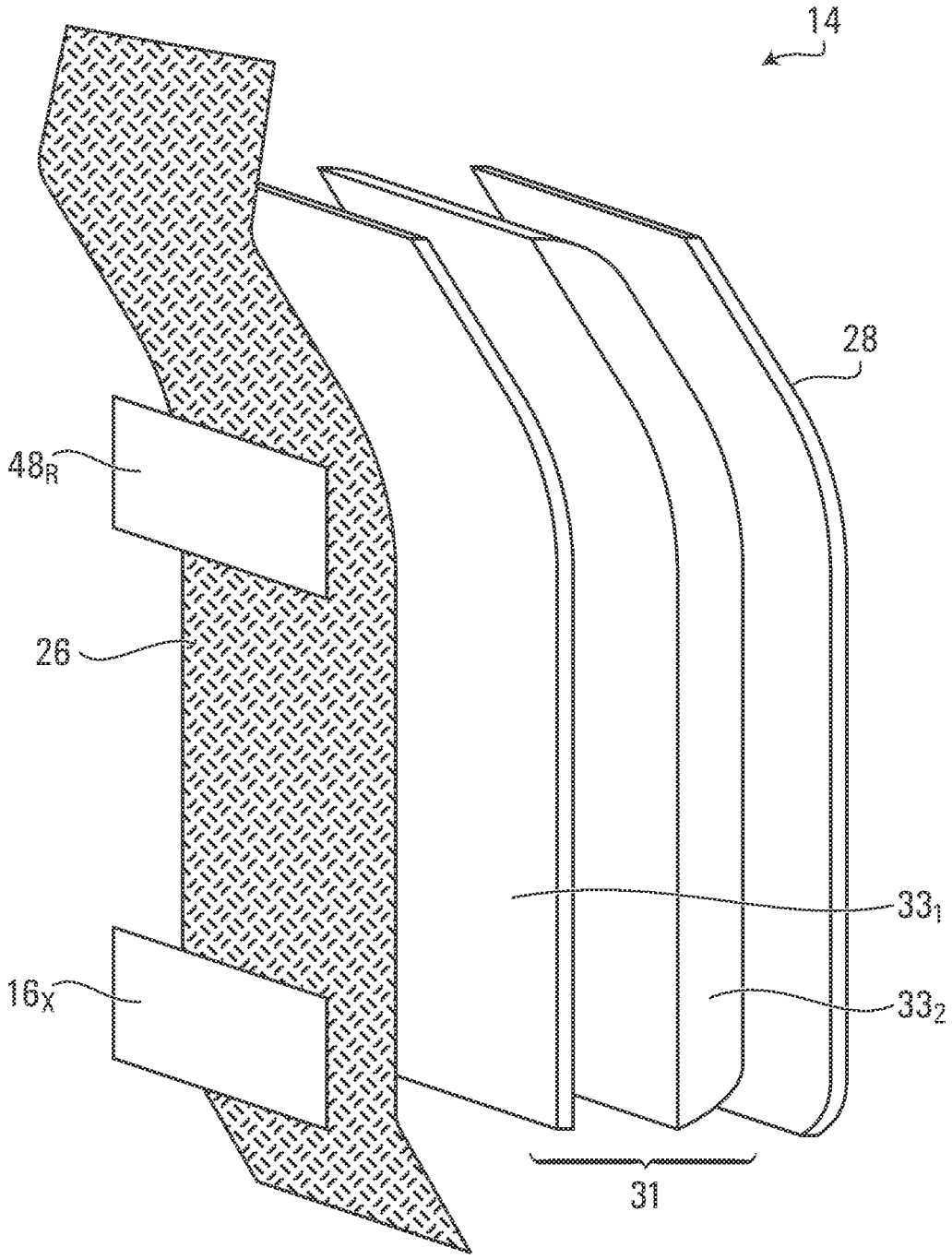
FIG. 4 is an exploded perspective view of a blocking member of the blocker.

As best shown in FIG. 4, in this embodiment, the blocking member 14 comprises an outer cover 26, an inner cover 28, and a pad 31 disposed between the outer cover 26 and the inner cover 28. The inner cover 28 is adjacent to the back portion 22 of the glove 12. The outer cover 26 and the inner cover 28 may be affixed to each other in any suitable manner. For example, the outer cover 26 and the inner cover 28 may be stitched, bonded or glued together.

The outer cover 26 and the inner cover 28 of the blocking member 14 may include any suitable material (e.g. any durable material, resistant to abrasion and tearing). For example, in some embodiments, the outer cover 26 and the inner cover 28 may include polyurethane (PU), polyethylene (PE), nylon, or leather.

The pad 31 is configured to provide impact absorption to the blocking member 14 in order to provide protection the goalie's fingers. More particularly, the pad 31 comprises protective padding 33. The protective padding 33 may comprise any suitable impact-absorbing material. For example, the protective padding 33 may comprise foam. In some examples of implementation, the foam may be polyurethane sponge foam, Poron®, ethylene vinyl acetate (EVA) foam, low-density polyethylene (LDPE), expanded polypropylene (EPP) foam, expanded polyethylene (EPE) foam, vinyl nitrile (VN) foam, or any other suitable foam. In other examples of implementation, the protective padding 33 may comprise gel. In some embodiments, the pad 31 may include two or more padding materials. For example, in this embodiment, the pad 31 may comprise pad members that include padding materials $\mathbf{33}_1$, $\mathbf{33}_2$. The padding materials $\mathbf{33}_1$, $\mathbf{33}_2$ may each comprise the same material or may comprise different materials.

In some embodiments, the blocking member 14 may be reinforced in order to provide additional wear resistance to areas which may be vulnerable to increased wear. More particularly, in some embodiments, the blocking member 14 may comprise areas of reinforcement $\mathbf{48}_1$-$\mathbf{48}_R$. The areas of reinforcement $\mathbf{48}_1$-$\mathbf{48}_R$ may comprise any suitable material.

The finger-protecting member 24 is configured to provide protection to the goalie's fingers that are received in the finger portions $\mathbf{16}_1$-$\mathbf{16}_4$ of the glove 12 (e.g., against the puck, such as when it is deflected, against a hockey stick, etc.).

Figure 6A:
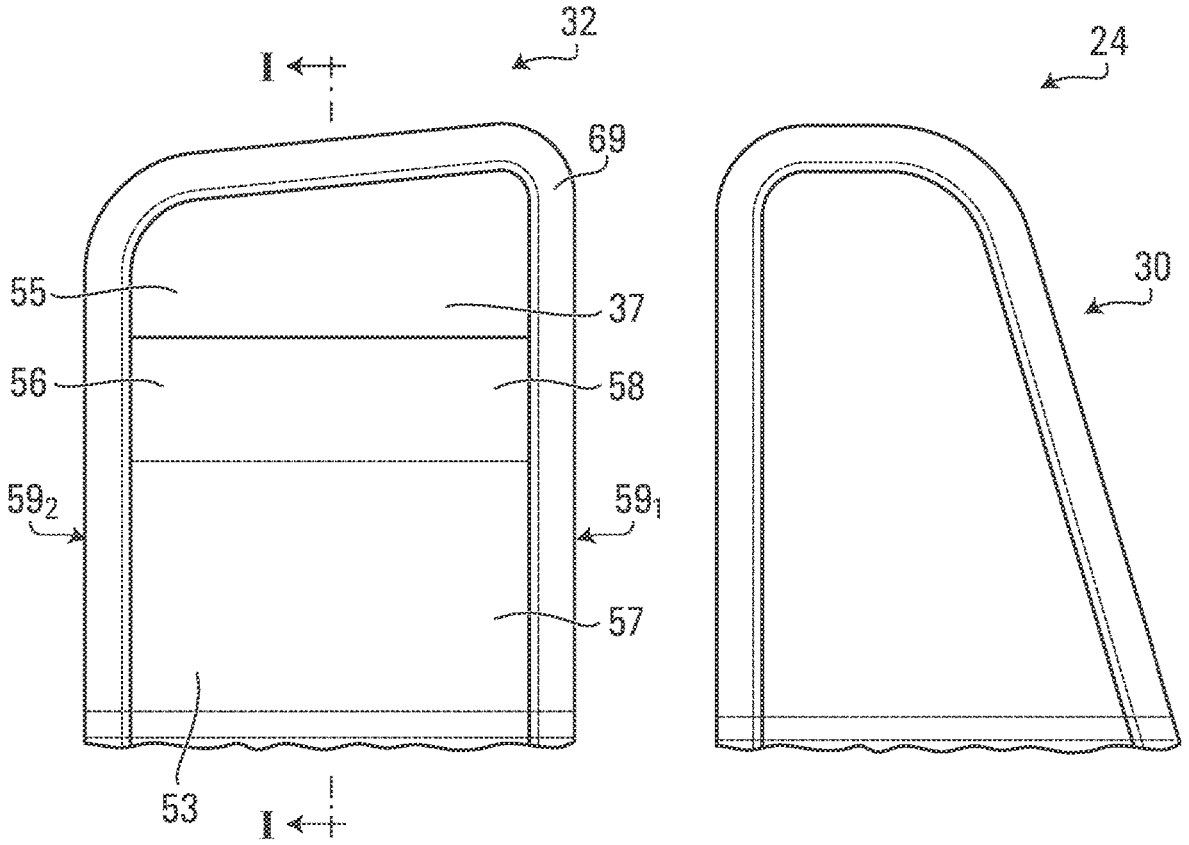
FIG. 6A is an enlarged view of a finger-protecting member of the blocker.
Figure 6B:
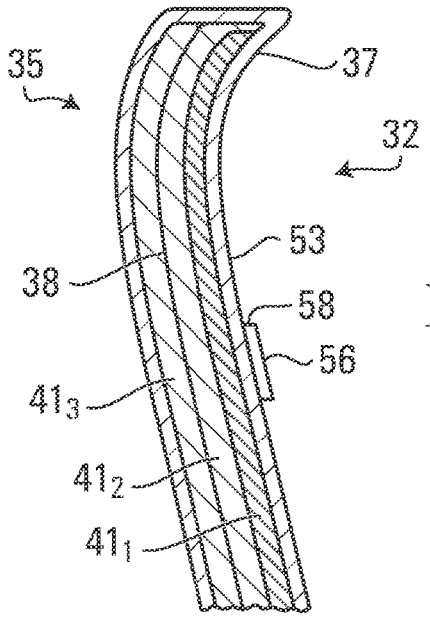
FIG. 6B is a cross-sectional view of a finger-protecting part of the finger-protecting member taken along line I-I of FIG. 6A.
Figure 7:
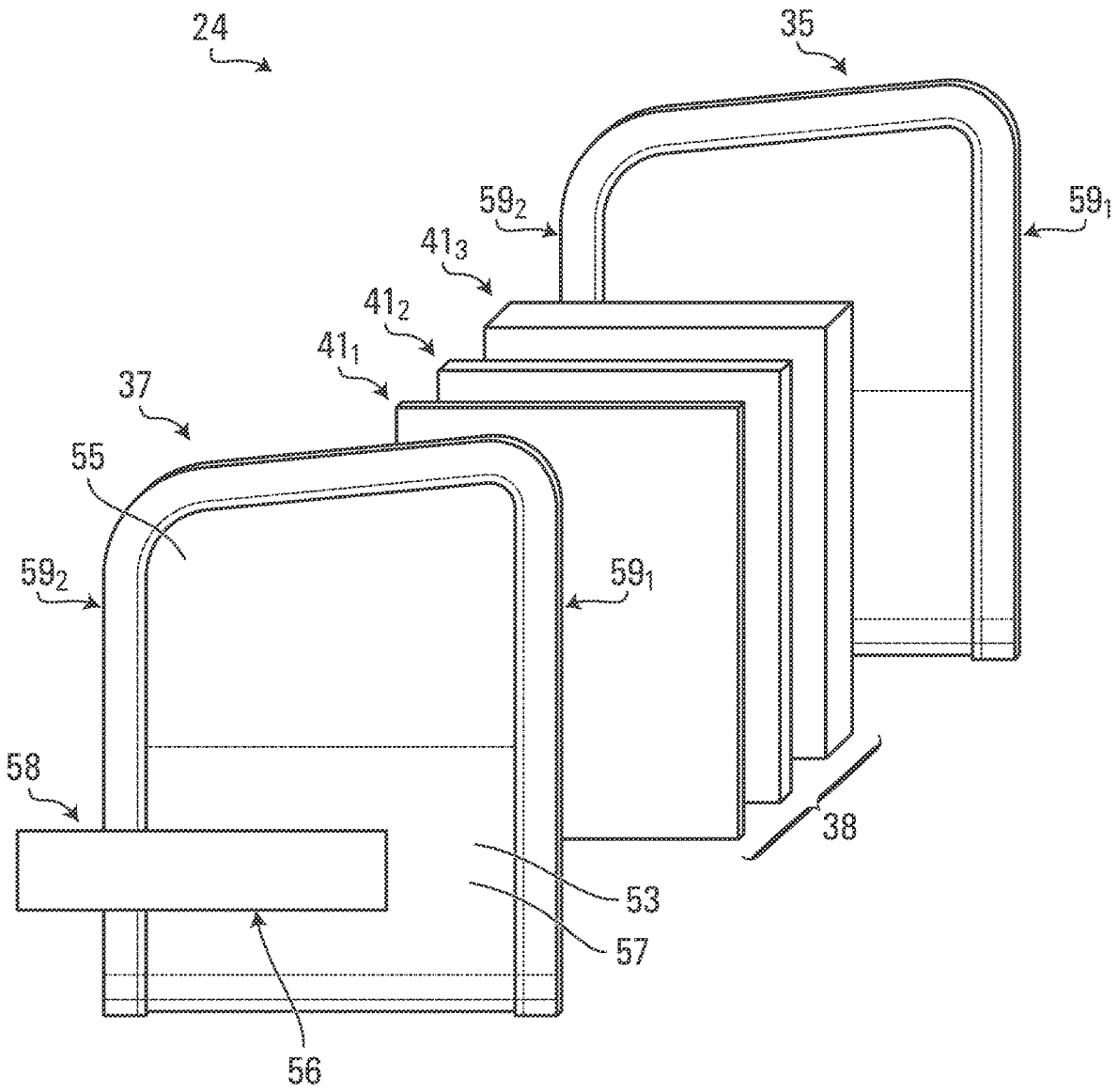
FIG. 7 is an exploded perspective view of a finger-protecting part of the finger-protecting member of FIG. 6A.

As best shown in FIGS. 6A, 6B, and 7, in this embodiment, the finger-protecting member 24 comprises an outer cover 35, an inner cover 37, and a pad 38 disposed between the outer cover 35 and the inner cover 37. The inner cover 37 is adjacent to the back side 17 of each of the finger portions $\mathbf{16}_1$-$\mathbf{16}_4$. The inner cover 37 and outer cover 35 may include any suitable material (e.g. any durable material, resistant to abrasion and tearing). For example, the inner cover 37 and the outer cover 35 may include polyurethane (PU), polyethylene (PE), nylon, or leather. The outer cover 35 and the inner cover 37 may be affixed together in any suitable manner. For example, the outer cover 35 and the inner cover 37 may be stitched, glued or bonded together. In another embodiment, a length of binding material 69 may be provided to surround the areas where the outer cover 35 and the inner cover 37 are affixed together.

The pad 38 is configured to provide impact absorption to the finger-protecting member 24 in order to provide protection the goalie's fingers. More particularly, the pad 38 comprises protective padding 41. The protective padding 41 may comprise any suitable impact-absorbing material. For example, the protective padding 41 may comprise foam. In some examples of implementation, the foam may be polyurethane sponge foam, Poron®, ethylene vinyl acetate (EVA) foam, molded high-density polyethylene (HDPE), irradiation cross-lined polyethylene (IXPE), expanded polypropylene (EPP) foam, expanded polyethylene (EPE) foam, vinyl nitrile (VN) foam, or any other suitable foam. In other examples of implementation, the protective padding 38 may comprise gel. In some embodiments, the pad 38 may include two or more padding materials. For example, in this embodiment, the pad 38 may comprise pad members that include padding materials $\mathbf{41}_1$, $\mathbf{41}_2$, $\mathbf{41}_3$. The padding materials $\mathbf{41}_1$, $\mathbf{41}_2$, $\mathbf{41}_3$ may each comprise the same material or may comprise different materials. In another embodiment, the padding materials 41 may be comprised of a plurality of sections, each section being movable relative to each other in order to facilitate flexion of the wearer's hand, including flexion of each of the wearer's fingers. Flexure lines may extend between respective ones of the sections $\mathbf{41}_y$ to facilitate flexion of the wearer's fingers.

In some embodiments, the pad 38 of the finger-protecting member 24 may have a substantially planar cross-sectional area. In other embodiments, the pad 38 may have a curved cross-sectional area, as best shown in FIG. 6B and cross-section I-I.

Figure 8A:
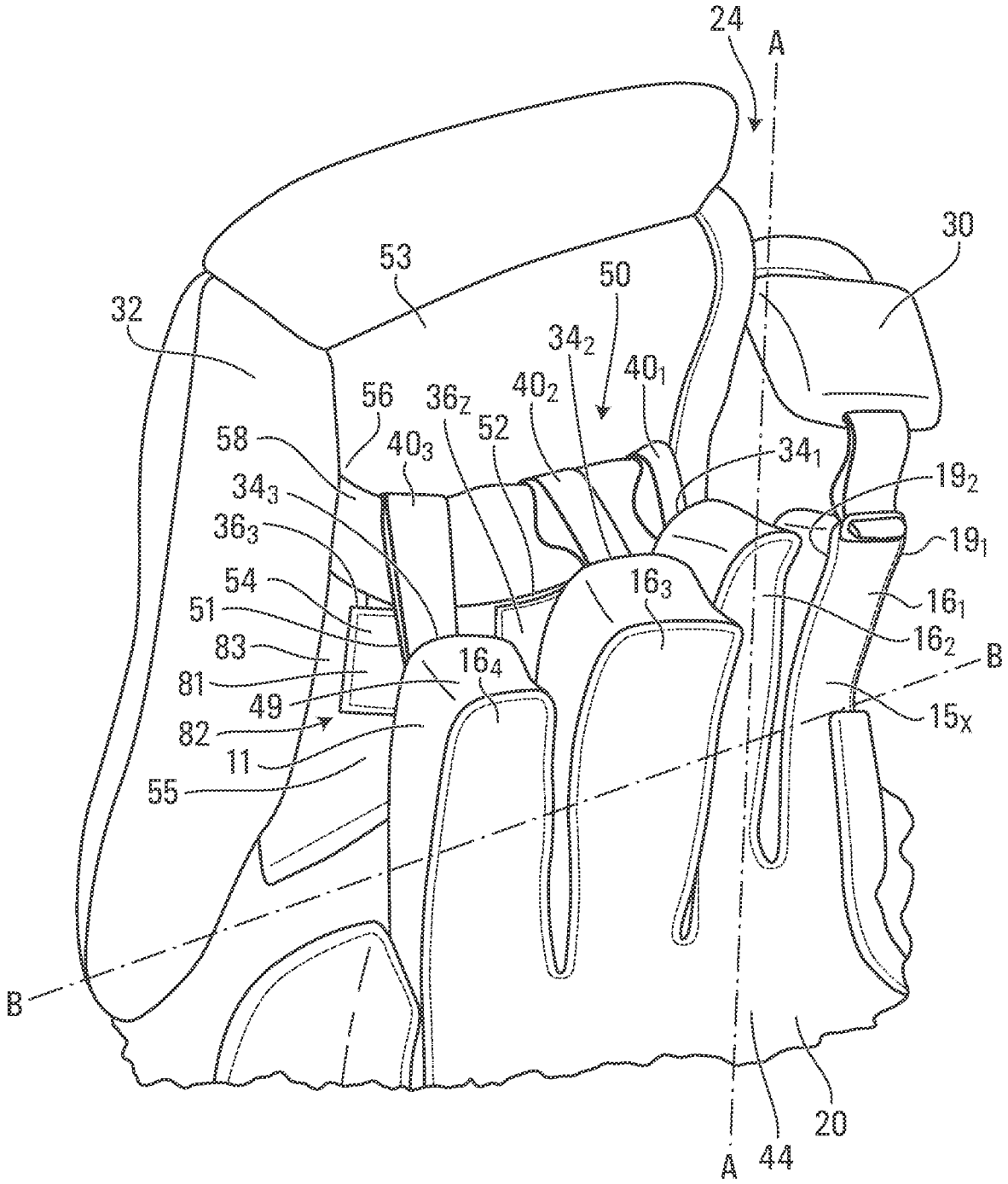
FIG. 8A is an enlarged view of one embodiment of an adjustment system of the blocker with fingers of the goalie's hand in a straight position.
Figure 8B:
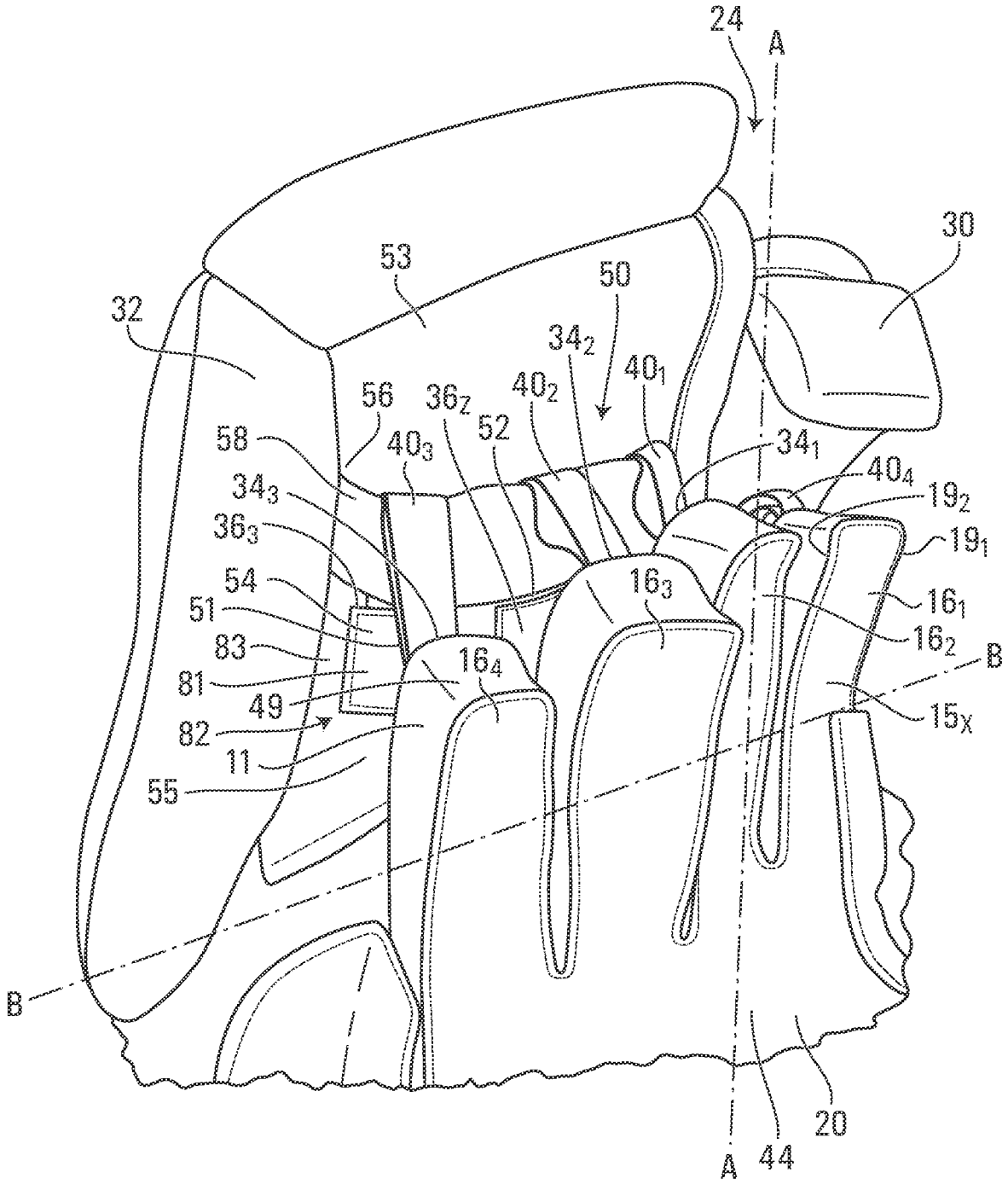
FIG. 8B is an enlarged view of another embodiment of an adjustment system of the blocker with fingers of the goalie's hand in a straight position.
Figure 8C:
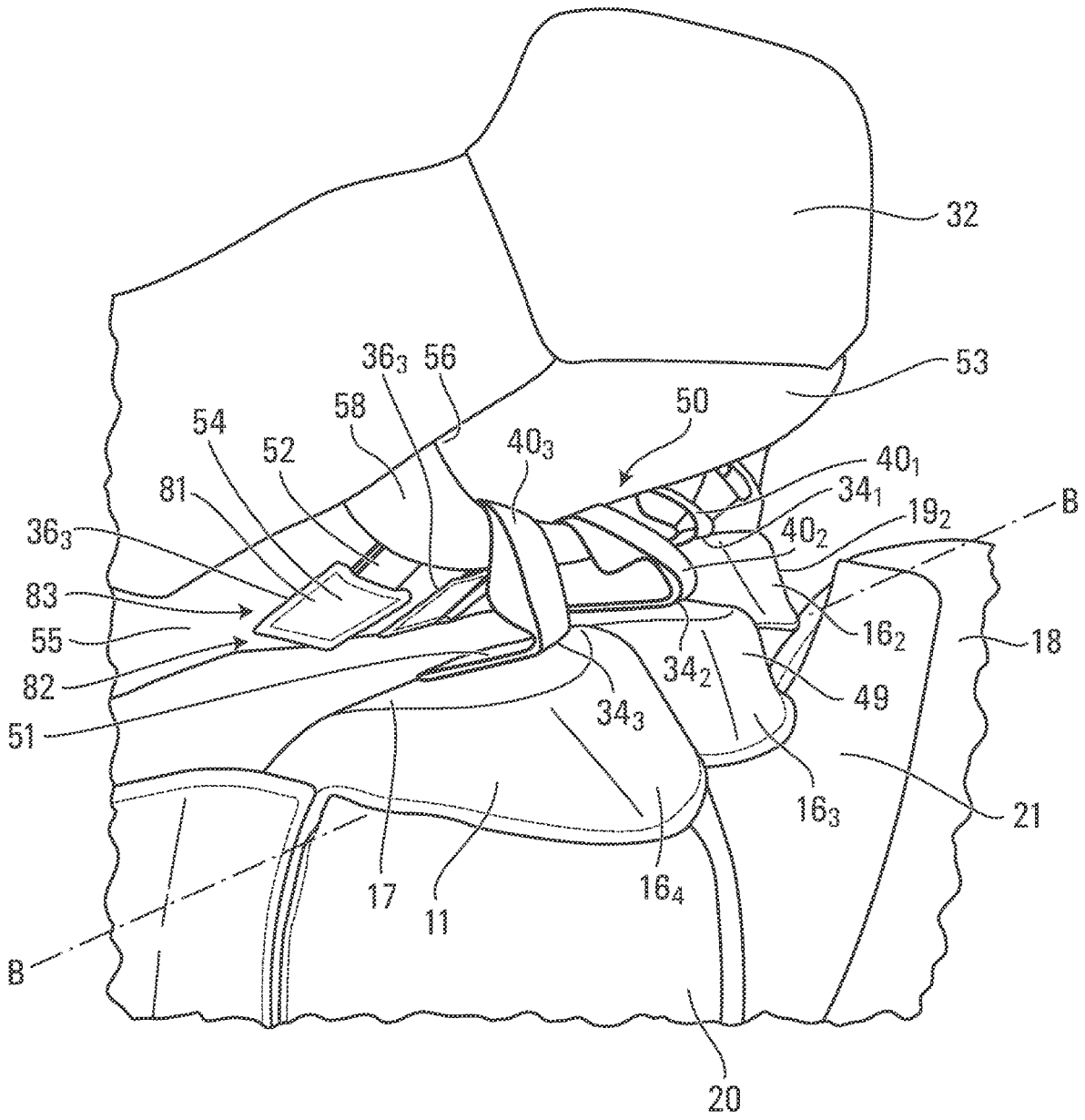
FIG. 8C is an enlarged view of the adjustment system of FIG. 8A with the fingers of the goalie's hand in a flexed position.

As shown in FIGS. 8A and 8B, in this embodiment, the finger-protecting member 24 comprises a finger-protecting part 30 disposed between and movable relative to the blocking member 14 and the finger portion $\mathbf{16}_1$ of the glove 12 and configured to protect an index finger of the goalie's hand that is received in the finger portion $\mathbf{16}_1$ of the glove 12, and a finger-protecting part 32 disposed between and movable relative to the blocking member 14 and the finger portions $\mathbf{16}_2$-$\mathbf{16}_4$ of the glove 12 and configured to protect middle, ring and little fingers of the goalie's hand that are received in the finger portions $\mathbf{16}_2$-$\mathbf{16}_4$ of the glove 12. The finger-protecting part 30 and the finger-protecting part 32, which may sometimes be referred to as finger-protecting "boards", are spaced from and movable relative to one another, based on movement of the goalie's fingers. In some instances, the finger-protecting parts 30, 32 may overlap over an area of overlap 70. The finger-protecting parts 30, 32 may overlie a tip surface 49 of each of the finger portions $\mathbf{16}_2$-$\mathbf{16}_4$. The finger-protecting parts 30, 32 may comprise a plurality of parts $\mathbf{30}x$, $\mathbf{32}_x$, each part $\mathbf{30}x$, $\mathbf{32}_x$ being movable relative to each other.

In this example of implementation, the blocker 10 comprises connectors $\mathbf{40}_1$-$\mathbf{40}_3$ connecting the finger-protecting part 32 to given ones of the finger portions $\mathbf{16}_2$-$\mathbf{16}_4$ of the glove 12. The connectors $\mathbf{40}_1$-$\mathbf{40}_3$ allow movement of the finger portions $\mathbf{16}_2$-$\mathbf{16}_4$ relative to the finger-protecting part 32 while maintaining the finger-protecting part 32 close to the finger portions $\mathbf{16}_2$-$\mathbf{16}_4$ when the goalie's middle, ring and little fingers move, such as by pulling on the finger-protecting part 32 when the goalie's middle, ring and little fingers are flexed. In this case, the connector $\mathbf{40}_1$ connects the finger-protecting part 32 to the finger portion $\mathbf{16}_2$, the connector $\mathbf{40}_2$ connects the finger-protecting part 32 to the finger portion $\mathbf{16}_3$, and the connector $\mathbf{40}_3$ connects the finger-protecting part 32 to the finger portion $\mathbf{16}_4$.

In this embodiment, the connectors $\mathbf{40}_1$-$\mathbf{40}_3$ are configured to enhance comfort and use, including by facilitating flexion and extension of the goalie's middle, ring and little finger and providing adjustability. For example, in some embodiments, this may allow the goalie to customize the blocker 10 to achieve a desired grip. This may offer better control and handling of the hockey stick in the hand and facilitate full articulation of the fingers around the stick. The connectors $\mathbf{40}_1$-$\mathbf{40}_3$ may allow more enhanced protection of the fingers by the finger-protecting part 32 as they may allow the finger-protecting part 32 to remain in close proximity to the fingers throughout their full range of motion thus limiting possible exposure to projectiles. Furthermore, the connectors $\mathbf{40}_1$-$\mathbf{40}_3$ may prevent material of the finger portions $\mathbf{16}_2$-$\mathbf{16}_4$ from twisting as the fingers are flexed and extended (straightened).

More particularly, in this embodiment, the connectors $\mathbf{40}_1$-$\mathbf{40}_3$ extend foldlessly, i.e., without folding or creasing, between the finger-protecting part 32 and the given ones of the finger portions $\mathbf{16}_2$-$\mathbf{16}_4$ of the glove 12. The connectors $\mathbf{40}_1$-$\mathbf{40}_3$ are thus free of folding or creasing, i.e., have no fold or crease, when the finger portions $\mathbf{16}_2$-$\mathbf{16}_4$ bend as the goalie's middle, ring and little fingers flex. This may be less obstructive and more comfortable than if the connectors $\mathbf{40}_1$-$\mathbf{40}_3$ were folded or creased.

Also, in the embodiment, the blocker 40 comprises an adjustment system 50 configured to adjust the connectors $\mathbf{40}_1$-$\mathbf{40}_3$ connecting the finger-protecting part 32 to the finger portions $\mathbf{16}_2$-$\mathbf{16}_4$ of the glove 12 such that each of these connectors $\mathbf{40}_1$-$\mathbf{40}_3$ is adjustable. More particularly, in this embodiment, a force exerted by each of the connectors $\mathbf{40}_1$-$\mathbf{40}_3$ between the finger portions $\mathbf{16}_2$-$\mathbf{16}_4$ and the finger-protecting part 32 is adjustable. This may allow a resistance to flexing of the finger portions $\mathbf{16}_2$-$\mathbf{16}_4$ into a flexed position and a bias of the finger portions $\mathbf{16}_2$-$\mathbf{16}_4$ towards an extended position to be adjusted, as desired by the goalie.

The connector $\mathbf{40}_1$ connecting the finger portion $\mathbf{16}_2$ to the finger-protecting part 32 will be further described with an understanding that a similar description applies to the connectors $\mathbf{40}_2$, $\mathbf{40}_3$.

In this embodiment, the connector $\mathbf{40}_1$ is straight in a widthwise direction of the connector $\mathbf{40}_1$ from a connection $\mathbf{34}_1$ of the connector $\mathbf{40}_1$ to the finger portion $\mathbf{16}_2$ to a connection $\mathbf{36}_1$ of the connector $\mathbf{40}_1$ to the finger-protecting part 32. Also, a width of the connector $\mathbf{40}_1$ at the connection $\mathbf{34}_1$ of the connector $\mathbf{40}_1$ to the finger portion $\mathbf{16}_2$ is transverse to a longitudinal direction of the finger portion $\mathbf{16}_2$. In this example, the width of the connector $\mathbf{40}_1$ at the connection $\mathbf{36}_1$ of the connector $\mathbf{40}_1$ to the finger portion $\mathbf{16}_2$ is substantially perpendicular to the longitudinal direction of the finger portion $\mathbf{16}_2$.

For example, in this embodiment, as the finger portion $\mathbf{16}_2$ flexes in response to bending of the goalie's middle finger, the connector $\mathbf{40}_1$ may remain substantially parallel to a longitudinal axis A-A of the finger portion $\mathbf{16}_2$. As such, the width of the connector $\mathbf{40}_1$ may be substantially parallel to a bending axis B-B of the finger portion $\mathbf{16}_2$. The connector $\mathbf{40}_1$ may thus be configured to remain substantially flat against the back side 17 of the finger portion $\mathbf{16}_2$ such that the material of the connector $\mathbf{40}_1$ does not crease or fold such as to obstruct the motion of the goalie's middle finger.

In this embodiment, the connector $\mathbf{40}_1$ may be stretchable. The connector $\mathbf{40}_1$ may comprise elastic material which provides tension when the finger portion $\mathbf{16}_2$ is flexed. More particularly, in some embodiments, the connector $\mathbf{40}_1$ may include a given length of elastic fabric such as an elastic strap comprised of Lycra®, neoprene, spandex, or latex. For instance, in some embodiments, the elastic material of the connector $\mathbf{40}_1$ may have a modulus of elasticity of at least 10,000 psi, in some cases at least 50,000 psi, or in some cases at least 100,000 psi.

The connector $\mathbf{40}_1$ may have any suitable width or length. For example, in some embodiments, the connector $\mathbf{40}_1$ may be 10 mm wide and 50 mm long. The connector $\mathbf{40}_1$ may comprise a single layer of fabric or may comprise a plurality of layers of fabric. In some embodiments, the connector $\mathbf{40}_1$ may be doubled (i.e. two distinct pieces of elastic may be provided over one another). This may increase the durability of the connector $\mathbf{40}_1$ and may avoid premature elastic fatigue.

The connector $\mathbf{40}_1$ comprises a first end 51 and a second end 52. In one embodiment, the first end 51 of the connector $\mathbf{40}_1$ is affixed to the back side 17 of a distal end 80 of the finger portion $\mathbf{16}_2$ to form the connection $\mathbf{34}_1$. The first end 51 of the connector $\mathbf{40}_1$ may be positioned such that is spaced from the lateral sides $\mathbf{19}_1$, $\mathbf{19}_2$ of finger portion $\mathbf{16}_2$. As such, the connector $\mathbf{40}_1$ is connected at the back side 17 of finger portion $\mathbf{16}_2$ and spaced from the lateral sides $\mathbf{19}_1$, $\mathbf{19}_2$ of the finger portion $\mathbf{16}_2$. The connector $\mathbf{40}_1$ may be affixed to the back side 17 of finger portion $\mathbf{16}_2$ in any suitable manner. For example, the connector $\mathbf{40}_1$ may be stitched or bonded to the back side 17.

In another embodiment, the first end 51 of connector $\mathbf{40}_1$ may be affixed to the tip surface 49 of the finger portion $\mathbf{16}_2$ to form the connection $\mathbf{34}_1$. The first end 51 of connector $\mathbf{40}_1$ may be positioned such that is spaced from the lateral sides $\mathbf{19}_1$, $\mathbf{19}_2$ of finger portion $\mathbf{16}_2$. As such, the connector $\mathbf{40}_1$ is connected at the tip surface 49 of the finger portion $\mathbf{16}_2$ and spaced from the lateral sides $\mathbf{19}_1$, $\mathbf{19}_2$ of the finger portion $\mathbf{16}_2$. The connector $\mathbf{40}_1$ may be affixed to the tip surface 49 of the finger portion $\mathbf{16}_2$ in any suitable manner, as described above.

The second end 52 of the connector $\mathbf{40}_1$ is configured to connect to finger-protecting part 32 to form the connection $\mathbf{36}_1$. The second end 52 of the connector $\mathbf{40}_1$ is detachably fastenable to an inner surface 53 of the finger-protecting part 32. The inner surface 53 of the finger-protecting part 32 constitutes a portion of an inner side 57 of the finger-protecting member 24. The connection $\mathbf{36}_1$ can be made in any suitable manner. In one embodiment, the second end 52 of the connector $\mathbf{40}_1$ may comprise a connecting element 54 including a hook portion 81 of a hook-and-loop fastener 82 and the finger-protecting part 32 may comprise a connecting element 55 disposed on the inside surface 53 of the finger-protecting part 32 including a loop portion 83 of the hook-and-loop fastener 82. The connecting elements 54, 55 are provided to detachably fasten the connector $\mathbf{40}_1$ to the finger-protecting part 32. The connecting element 54 is movable relative to the finger-protecting member 24 and is configured to engage with the connecting element 55 of the finger-protecting part 32. The connecting element 54 of the connector $\mathbf{40}_1$ may be connectable at a plurality of positions relative to the connecting element 55 of the finger-protecting member 24 for adjusting the connector $\mathbf{40}_1$. In other embodiments, the connection element 54 may comprise the loop portion 83 of the hook-and-loop fastener 82 while the connecting element 55 may comprise the hook portion 81 of the hook-and-loop fastener 82.

Figure 9A:
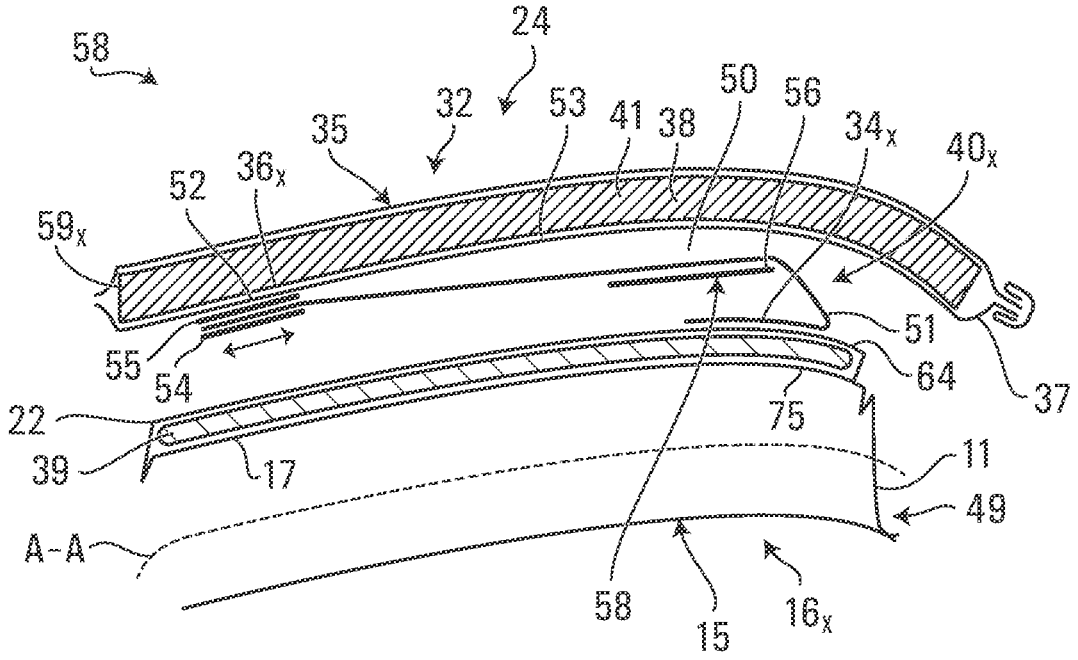
FIG. 9A is an enlarged cross-sectional view of the adjustment system in a first position.
Figure 9B:
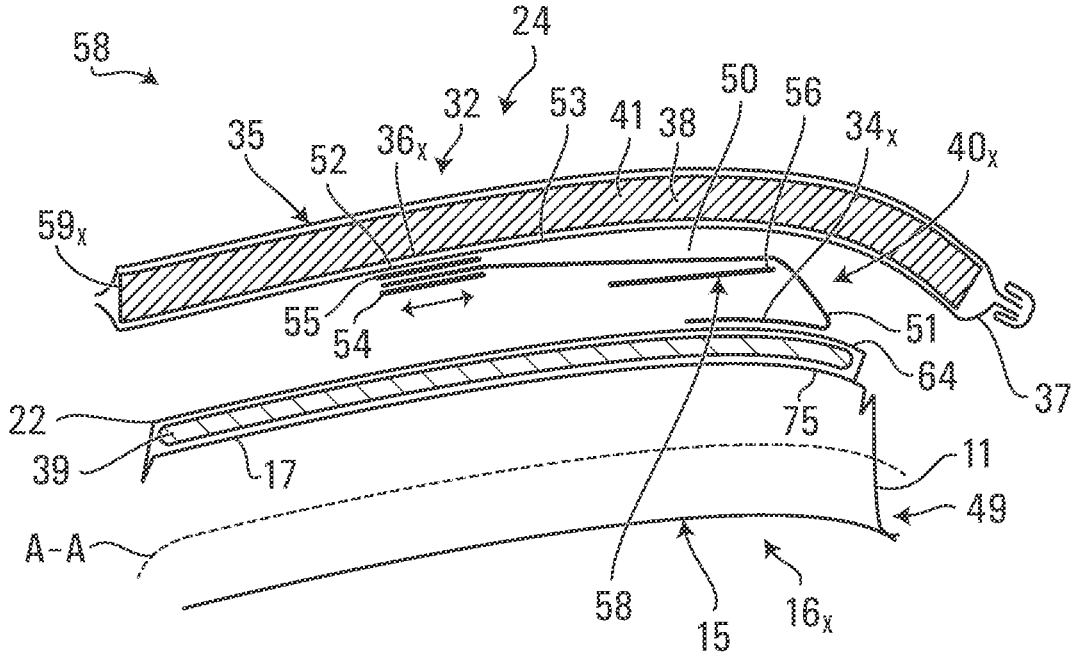
FIG. 9B is an enlarged cross-sectional view of the adjustment system in an alternate position.

The connector $\mathbf{40}_1$ is adjustable with respect to the finger-protecting member 24 and the finger portion $\mathbf{16}_2$. For example, the force exerted by connector $\mathbf{40}_1$ between the finger portion $\mathbf{16}_2$ and the finger-protecting part 32 is adjustable by altering the position of the connecting element 54 of the second end 52 of the connector $\mathbf{40}_1$ relative to the connecting element 55 of the finger protecting part 32. For example, FIG. 9A shows a cross-sectional area of the adjustment system 50 showing the connector $\mathbf{40}_1$ in a first position, whereas FIG. 9B shows a cross-sectional area of the adjustment system 50 showing the connector $\mathbf{40}_1$ in an alternate position. The force exerted by the connector $\mathbf{40}_1$ between the finger portion $\mathbf{16}_2$ and the finger-protecting part 32 may be adjusted in any other suitable way.

As shown in FIG. 7, in this embodiment, the finger-protecting member 24 may comprise a guide 56 for guiding the connector $40_1$. The guide 56 may be disposed between the respective ones of the finger portions $16_2$, $16_3$, $16_4$ and the inner side 57 of the finger-protecting member 24. In this embodiment example, the guide 56 comprises a webbing 58. For example, in some embodiments, a length of non-elastic fabric may be provided such as of nylon, a tricot material, a woven fabric, a nonwoven fabric, synthetic microfibers, or a synthetic woven knit. In another embodiment, a length of flexible fabric may be provided such as elastic strap comprised of Lycra®, neoprene, spandex, or latex. In another embodiment, the guide 56 may comprise of a plurality of sections.

In this embodiment, the webbing 58 may be sewn or attached in any other suitable way to the inner side 57 of the finger-protecting member 24. The webbing 58 may extend from a first lateral side $59_1$ of the finger-protecting member 24 to a second lateral side $59_2$ of the finger-protecting member 24. The second end 52 of connector $40_1$ may be passed beneath the webbing 58. As such, the connector $40_1$ follows the inner side 57 of the finger-protecting member 24 and bends about the guide 56 towards the finger portions $16_2$. In this example, each of the connectors $40_1$-$40_3$ are disposed to pass between the guide 56 and the inner side 57 of the finger-protecting member 24.

The blocker 10 may be implemented in various other ways in other embodiments.

For example, in other embodiments, there may be fewer or more connectors like the connectors $40_1$-$40_3$ which connect to one or more of the finger portions $16_2$-$16_4$ of the glove 12.

In some embodiments, the blocker 10 may comprise a connector $40_4$, similar to the connectors $40_1$-$40_3$, which connects the finger-protecting part 30 to the finger portion $16_1$ of the glove 12.

In some embodiments, a finger-protecting part $32_x$ may be provided for each of the finger portions $16_2$, $16_3$, and $16_4$.

In some embodiments, the connecting elements 54, 55 for each of the connectors $40_1$-$40_3$ may be implemented in any other suitable way. For example, they may comprise buttons, clips, and/or any other detachable fastener.

Certain additional elements that may be needed for operation of some embodiments have not been described or illustrated as they are assumed to be within the purview of those of ordinary skill in the art. Moreover, certain embodiments may be free of, may lack and/or may function without any element that is not specifically disclosed herein.

Any feature of any embodiment discussed herein may be combined with any feature of any other embodiment discussed herein in some examples of implementation.

In case of any discrepancy, inconsistency, or other difference between terms used herein and terms used in any document incorporated by reference herein, meanings of the terms used herein are to prevail and be used.

Although various embodiments have been illustrated, this was for purposes of describing, but should not be limiting. Various changes, modifications and enhancements may be made.

The invention claimed is:

1. A blocker for a hand of a goalie, the blocker comprising:

a glove configured to receive the goalie's hand, the glove comprising:

finger portions configured to receive fingers of the goalie's hand; and a thumb portion configured to receive a thumb of the goalie's hand;

a blocking member disposed over the glove and configured to block a puck or ball;

a finger-protecting member disposed between and movable relative to the blocking member and respective ones of the finger portions and configured to protect respective ones of the goalie's fingers that are received in the respective ones of the finger portions; and a connector connecting the finger-protecting member to a given one of the finger portions and extending foldlessly between the finger-protecting member and the given one of the finger portions.

2. The blocker of claim 1, wherein a width of the connector at a connection of the connector to the given one of the finger portions is transverse to a longitudinal direction of the given one of the finger portions.

3. The blocker of claim 2, wherein the width of the connector at the connection of the connector to the given one of the finger portions is substantially perpendicular to the longitudinal direction of the given one of the finger portions.

4. The blocker of claim 1, wherein the connector is straight in a widthwise direction of the connector from a connection of the connector to the given one of the finger portions to a connection of the connector to the finger-protecting member.

5. The blocker of claim 1, wherein a width of the connector is substantially parallel to a bending axis of the given one of the finger portions.

6. The blocker of claim 1, wherein the connector is connected at a back side of the given one of the finger portions and spaced from lateral sides of the given one of the finger portions.

7. The blocker of claim 1, wherein the connector comprises a strap.

8. The blocker of claim 7, wherein the strap is an elastic strap.

9. The blocker of claim 1, wherein the connector is adjustable.

10. The blocker of claim 9, wherein the connector is adjustable between the finger-protecting member and the given one of the finger portions.

11. The blocker of claim 9, wherein a force exerted by the connector between the given one of the finger portions and the finger-protecting member is adjustable.

12. The blocker of claim 1, wherein the connector comprises a connecting element movable relative to the finger-protecting member; and the finger-protecting member comprises a connecting element configured to engage the connecting element of the connector.

13. The blocker of claim 12, wherein the connecting element of the connector comprises a portion of a hook-and-loop fastener and the connecting element of the finger-protecting member comprises a portion of the hook-and-loop fastener.

14. The blocker of claim 13, wherein the portion of the hook-and-loop fastener of the connecting element of the connector comprises a hook portion of the hook-and-loop fastener and the portion of the hook-and-loop fastener of the connecting element of the finger-protecting member comprises a loop portion of the hook-and-loop fastener.

15. The blocker of claim 12, wherein the connecting element of the connector is connectable at a plurality of positions relative to the connecting element of the finger-protecting member for adjusting the connector.

16. The blocker of claim 1, wherein the finger-protecting member comprises a guide guiding the connector and disposed between the respective ones of the finger portions and an inner side of the finger-protecting member.

17. The blocker of claim 16, wherein the connector follows the inner side of the finger-protecting member and bends about the guide towards the given one of the finger portions.

18. The blocker of claim 16, wherein the guide comprises webbing.

19. The blocker of claim 1, wherein: the connector is a first connector; the given one of the finger portions is a first one of the finger portions; and the glove comprises a second connector connecting the finger-protecting member to a second one of the finger portions and extending foldlessly between the finger-protecting member and the second one of the finger portions.

20. The blocker of claim 19, wherein the finger-protecting member comprises a guide guiding the first connector and the second connector and disposed between the respective ones of the finger portions and an inner side of the finger-protecting member.

21. The blocker of claim 19, wherein the glove comprises a third connector connecting the finger-protecting member to a third one of the finger portions and extending foldlessly between the finger-protecting member and the third one of the finger portions.

22. The blocker of claim 1, wherein the finger-protecting member comprises: a first finger-protecting part disposed between and movable relative to the blocking member and an index one of the finger portions and configured to protect an index one of the goalie's fingers that is received in the index one of the finger portions; and a second finger-protecting part disposed between and movable relative to the blocking member and middle, ring and little ones of the finger portions and configured to protect middle, ring and little ones of the goalie's fingers that are received in the middle, ring and little ones of the finger portions, and are spaced from and movable relative to the first finger-protecting part.

23. The blocker of claim 22, wherein: the given one of the finger portions is a given one of the middle, ring and little ones of the finger portions; and the connector connects the second finger-protecting part to the given one of the middle, ring and little ones of the finger portions.

24. The blocker of claim 1, wherein: a connection of the connector to the finger-protecting member is located on an inner side of the finger-protecting member; and a connection of the connector to the given one of the finger portions is spaced from a palm side of the given one of the finger portions.

25. The blocker of claim 24, wherein the connection of the connector to the given one of the finger portions is located on a back side of the given one of the finger portions.

26. A blocker for a hand of a goalie, the blocker comprising:

a glove configured to receive the goalie's hand, the glove comprising:

finger portions configured to receive fingers of the goalie's hand; and a thumb portion configured to receive a thumb of the goalie's hand;

a blocking member disposed over the glove and configured to block a puck or ball;

a finger-protecting member disposed between and movable relative to the blocking member and respective ones of the finger portions and configured to protect respective ones of the goalie's fingers that are received in the respective ones of the finger portions; and a connector connecting the finger-protecting member to a given one of the finger portions, the connector being straight in a widthwise direction of the connector from a connection of the connector to the given one of the finger portions to a connection of the connector to the finger-protecting member, the connection of the connector to the finger-protecting member being located on an inner side of the finger-protecting member.

27. A blocker for a hand of a goalie, the blocker comprising:

a glove configured to receive the goalie's hand, the glove comprising:

finger portions configured to receive fingers of the goalie's hand; and a thumb portion configured to receive a thumb of the goalie's hand;

a blocking member disposed over the glove and configured to block a puck or ball;

a finger-protecting member disposed between and movable relative to the blocking member and respective ones of the finger portions and configured to protect respective ones of the goalie's fingers that are received in the respective ones of the finger portions; and a connector connecting the finger-protecting member to a given one of the finger portions, a width of the connector at a connection of the connector to the given one of the finger portions being transverse to a longitudinal direction of the given one of the finger portions, the connection of the connector to the given one of the finger portions is spaced from a palm side of the given one of the finger portions.

28. A blocker for a hand of a goalie, the blocker comprising:

a glove configured to receive the goalie's hand, the glove comprising:

finger portions configured to receive fingers of the goalie's hand; and a thumb portion configured to receive a thumb of the goalie's hand;

a blocking member disposed over the glove and configured to block a puck or ball;

a finger-protecting member disposed between and movable relative to the blocking member and respective ones of the finger portions and configured to protect respective ones of the goalie's fingers that are received in the respective ones of the finger portions; and a connector connecting the finger-protecting member to a given one of the finger portions, the connector being connected at a back side of the given one of the finger portions and spaced from lateral sides of the given one of the finger portions.

29. A blocker for a hand of a goalie, the blocker comprising:

a glove configured to receive the goalie's hand, the glove comprising:

finger portions configured to receive fingers of the goalie's hand; and a thumb portion configured to receive a thumb of the goalie's hand;

a blocking member disposed over the glove and configured to block a puck or ball;

a finger-protecting member disposed between and movable relative to the blocking member and respective ones of the finger portions and configured to protect respective ones of the goalie's fingers that are received in the respective ones of the finger portions; and a connector connecting the finger-protecting member to a given one of the finger portions, the connector being adjustable.

* * * * *